US005511247A

United States Patent [19]

Block

[11] Patent Number: 5,511,247

[45] Date of Patent: Apr. 30, 1996

[54] SPORTS GLOVE WITH FOREFINGER STIFFENER

[75] Inventor: Alvin Block, Palm Beach Gardens, Fla.

[73] Assignee: John Cimba, Palm Beach Gardens, Fla.; a part interest

[21] Appl. No.: 267,116

[22] Filed: Jun. 24, 1994

[51] Int. Cl.[6] ..... A41D 19/00

[52] U.S. Cl. ..... 2/161.1; 2/161.2; 2/160

[58] Field of Search ..... 2/159, 160, 161.1, 2/161.2, 161.3, 161.4, 163, 164, 166, 21, 907, 917, 255, 256; 473/59, 61, 62; 273/188 R, 189 R; 602/21, 22

[56] References Cited

U.S. PATENT DOCUMENTS

| | | | |
|---|---|---|---|
| 1,483,595 | 2/1924 | Read | 2/159 X |
| 2,436,755 | 2/1948 | Lapell | 2/161.2 X |
| 2,554,991 | 5/1951 | Kramer | 2/159 |
| 2,751,598 | 6/1956 | Romeo | 2/161.3 |
| 2,831,196 | 4/1958 | Scheiber | 2/161.2 |
| 2,928,102 | 3/1960 | Canausa | 2/161.2 |
| 3,593,803 | 7/1971 | Ibach | 2/160 |
| 3,707,730 | 1/1973 | Slider | 2/161.1 |
| 3,875,591 | 4/1975 | Cantales | 473/59 X |
| 4,146,935 | 4/1979 | Hinton | 2/161.3 X |
| 4,173,218 | 11/1979 | Cronin | 602/21 |
| 4,658,445 | 4/1987 | Tribble | 2/161.2 |
| 4,675,914 | 6/1987 | Mitchell | 2/161.1 |

FOREIGN PATENT DOCUMENTS

| | | | |
|---|---|---|---|
| 6039073 | 2/1994 | Japan | 2/161.2 |
| 2237726 | 5/1991 | United Kingdom | 2/159 |
| 8601707 | 3/1986 | WIPO | 602/21 |

*Primary Examiner*—Michael A. Neas
*Attorney, Agent, or Firm*—Kirschstein et al.

[57] ABSTRACT

A forefinger sheath and/or a thumb sheath of a glove worn on a player's power hand are stiffened to prevent the tips of the forefinger and thumb from curling toward and pressing against each other and activating muscles that would otherwise ruin a swing of a sports implement, such as a golf club. A strap is also used to immobilize the thumb in the thumb sheath.

13 Claims, 2 Drawing Sheets

FIG. 1
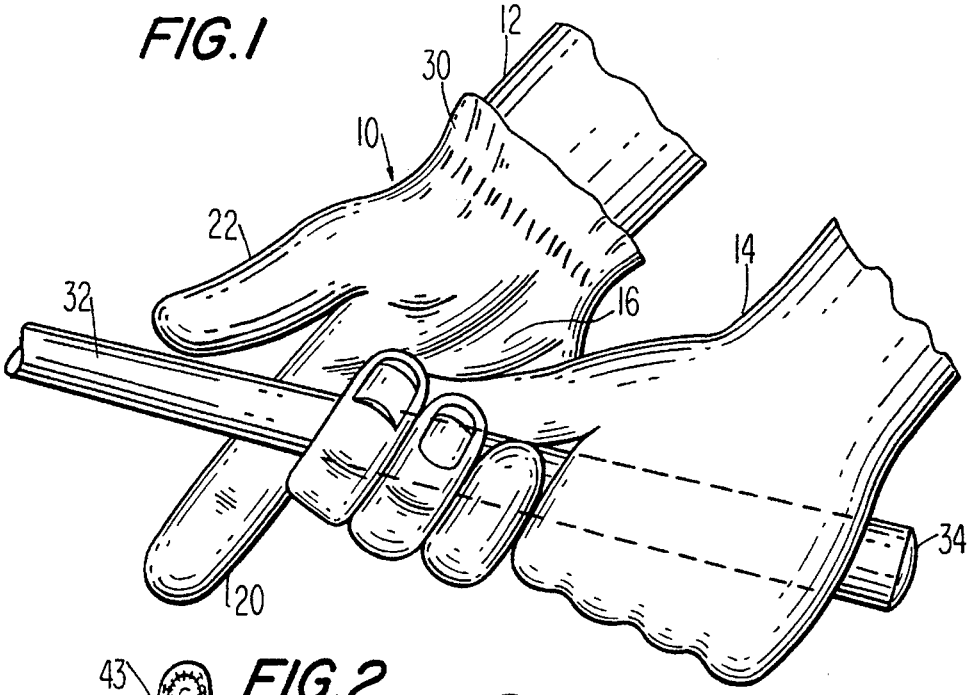
FIG. 2
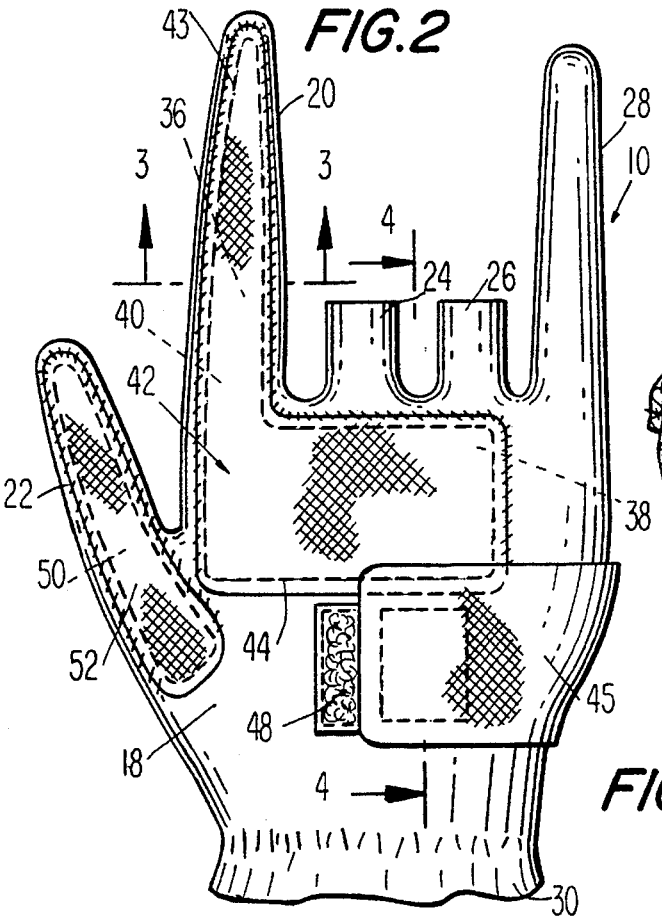
FIG. 3
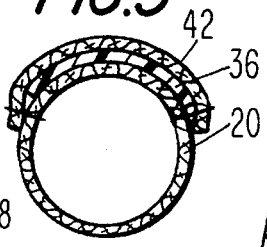
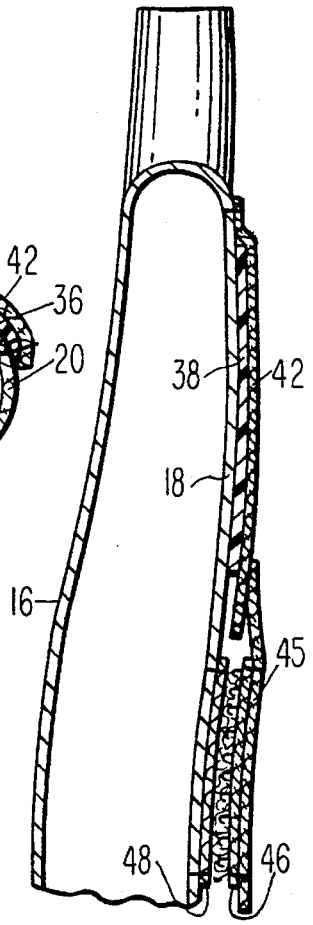
FIG. 4

6
36
54
72
40
68
56
38
60
70
6
66
64

54
36
40
62
72
70
56
38
60
58

90
86
80
88
8
82
8

80
86
82
84
88

SPORTS GLOVE WITH FOREFINGER STIFFENER

BACKGROUND OF THE INVENTION

1. Field of the Invention

This invention generally relates to a sports glove for weakening a player's power hand grip on a handled sports implement to be swung and, more particularly, to resisting overpowering a swing of the implement during sports activities.

2. Description of the Related Art

In golf, tennis, baseball, racquetball and like sports activities wherein a handled implement such as a club, racket or bat is gripped and swung at a ball by a player, an incorrect grip can ruin the swing and, in turn, cause the ball to be misdirected. For example, a common problem in golf relates to overpowering the swing, thereby causing a poorly executed golf shot. This problem is caused by either consciously or unconsciously gripping the golf club improperly and/or too tightly with the forefinger and thumb of the power hand, i.e., the right hand for a right-handed player, or the left hand for a left-handed player. For a proper swing, the tips of the forefinger and the thumb of the power hand should not curl towards or tightly press against each other during the golf swing. This pressure automatically activates certain muscles in the power hand arm and shoulder, which muscles should not be activated since they tend to ruin the swing.

Various sports gloves are known in the art. For example, U.S. Pat. Nos. 2,154,197 and 2,831,196 disclose the placement of stiffeners across a golfer's wrist, and U.S. Pat. No. 4,675,914 discloses the placement of adjustable coil springs in any one or all of the finger sheaths of a glove to enhance a golfer's grip. None of the known gloves, however, are concerned with weakening a player's power hand grip to resist overpowering a swing of a sports implement.

SUMMARY OF THE INVENTION

Objects of the Invention

It is a general object of this invention to weaken a player's power hand grip on a handled sports implement during a swing.

Another object is to prevent a player from consciously or unconsciously overpowering a swing of a sports implement from the player's power side.

Still another object of this invention is to effectively prevent the tips of the forefinger and the thumb of the player's power hand from curling towards or pressing against each other.

Yet another object of this invention is to prevent a player from improperly gripping the implement with the power hand.

An additional object of this invention is to provide a reliable, simple yet effective, hand-mounted device, especially a glove for the power hand of a sports enthusiast that automatically corrects a common fault in swinging sports implements, particularly golf clubs.

FEATURES OF THE INVENTION

In keeping with these objects and others which will become apparent hereinafter, one feature of this invention resides, briefly stated, in a hand-mounted device, especially a glove for weakening a player's power hand grip on a handle of a movable sports implement. The glove comprises a power hand cover which includes an elongated, outstretched, forefinger sheath for receiving a forefinger of the player's power hand when worn, and forefinger stiffener means associated with the forefinger sheath for maintaining outstretched the forefinger sheath and the forefinger therein during movement of the implement.

In the preferred embodiment, the forefinger stiffener means includes a stiffener element having an elongated extension extending along the forefinger sheath in a longitudinal direction. The extension is formed with a curved contour in a transverse direction generally normal to the longitudinal direction in order to conform to the top of the forefinger of the player's power hand for increased comfort. The stiffener element includes a base integral with the extension. The base is remote from the forefinger sheath and is juxtaposed with a back portion of the cover.

A pocket portion is juxtaposed with the cover and bounds a compartment for receiving the stiffener element. The pocket portion may be an outer flap secured to an exterior surface of the cover, or may be an inner flap secured to an inner surface of the cover.

In accordance with another feature of this invention, the cover includes an elongated, outstretched, thumb sheath for receiving a thumb of the player's power hand when worn. Thumb stiffener means are associated with the thumb sheath for maintaining outstretched the thumb sheath and the thumb therein. Preferably, the thumb stiffener means includes a stiffener member extending along the thumb sheath. The stiffener member and the stiffener element are both preferably constituted of a molded, rigid, synthetic plastic material.

Still another feature of this invention resides in directly attaching the thumb sheath to the back portion of the glove so that the thumb sheath lies in a generally parallel, side-by-side relationship with the forefinger sheath. For this purpose, connector means are used. Preferably, the connector means includes a strap connected to, and extending between, the thumb sheath and the back portion. The back portion is advantageously constituted of a fibrous material, and the strap is provided with hooked fasteners for detachable securement to the fibrous material. Alternatively, the thumb and forefinger sheaths can simply be sewn together, or be fabricated as a common mitten-like sheath.

The forefinger stiffener element, the thumb stiffener member, and the attached forefinger and thumb sheaths, either singly or in combination, ensure that the tips of the forefinger and the thumb do not curl toward or press tightly against each other and ruin the swing of the sports implement. The forefinger and thumb of the player's power hand are effectively prevented from curling around the handle of the sports implement. With the fingers of the player's power hand correctly positioned on the handle, the swing of the implement will not be overpowered.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of one embodiment of a glove in accordance with this invention worn on a player's power hand while gripping a sports implement shown in broken-away view;

FIG. 2 is a top plan view of the embodiment of FIG. 1;

FIG. 3 is an enlarged sectional view taken on line 3—3 of FIG. 2;

FIG. 4 is a broken-away sectional view taken on line 4—4 of FIG. 2;

DETAILED DESCRIPTION OF THE PREFERRED EMBODIMENTS

Figure 5:
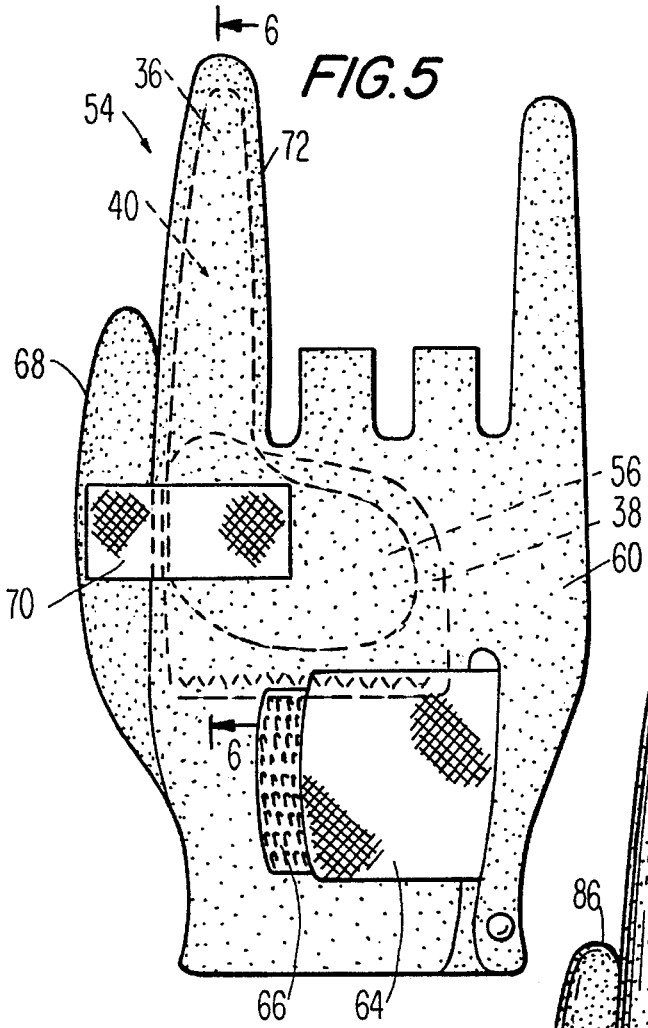
FIG. 5 is a top plan view of another embodiment of a glove in accordance with this invention.

Referring now to the drawings, reference numeral 10 in FIGS. 1 through 4 generally identifies a first embodiment of a hand-mounted device, especially a glove to be worn on a power hand 12 of a sports enthusiast. The power hand 12 is the right hand for a right-handed player, and is the left hand for a left-handed player. The other hand is known as the non-power hand 14 and, as shown, a right-handed player does not wear the glove 10 on the non-power hand 14.

The glove 10 includes a hand-shaped cover having a palm portion 16 overlying the palm of the player's power hand, a back portion 18 overlying the back of the player's power hand, a forefinger sheath 20, a thumb sheath 22, a middle finger sheath 24, a ring finger sheath 26 and a pinky sheath 28. The sheaths receive the corresponding fingers of the power hand 12. The sheaths 20, 22, 28 are complete, i.e., they fully enclose their corresponding fingers. The sheaths 24, 26 are cut-off, i.e., they only partially enclose their corresponding fingers. The sheaths 24, 26 could be complete. The sheath 28 could be cut-off. The glove is constructed of forming, preferably by stitching, one or more pieces of leather, cloth, fabric or analogous material, either stretchable or non-stretchable, woven or non-woven. Non-illustrated ventilation holes in the palm and/or back portions, as well as a friction-enhancing gripping surface on the exterior surface of the palm portion may be provided. A cuff 30 overlying the wrist of the power hand may optionally be provided.

FIG. 1 shows how a right-handed player should grip a golf club 32, with the power hand 12 gripping the club 32 further away from the end 34 of the club as compared to the non-power hand 14. As previously described, a proper golf shot requires a proper grip. In order to prevent the player from overpowering the swing, the forefinger and the thumb of the power hand must not curl around the club 32 with undue force, and the tips of the forefinger and the thumb should not be pressed too tightly together.

In accordance with this invention, the glove 10, as described so far, is modified to prevent the forefinger and/or the thumb from improperly or too tightly gripping the club. Thus, one feature resides in associating a forefinger stiffener means 40 with the forefinger sheath 20. The stiffener means or element 40 includes an elongated extension 36 extending lengthwise along the sheath 20, and a base 38 which is integral with the extension 36, and which is juxtaposed with the back portion 18 to at least partially overlie the back of the hand 12. The stiffener element 40 is preferably a one-piece, molded, synthetic plastic material, element but any rigid, non-bendable material will suffice. The extension 36 preferably has a curved contour in the transverse direction to conform to the contour of the upper surface of the forefinger.

The stiffener element 40 can be mounted exteriorly of the cover, i.e., above the back portion 18, as shown in the first embodiment of FIGS. 1 through 4 or, as will be described below, in connection with the second embodiment of FIGS. 5 and 6, the stiffener element 40 can be mounted interiorly of the cover, i.e., between the back portion 18 and the palm portion 16. As best seen in FIG. 2, a generally L-shaped pocket portion 42 overlies the back portion 18 and bounds a compartment or pocket in which the stiffening element 40 is received. Pocket portion 42 has a peripheral shape corresponding to the periphery of the stiffener element 40 and is stitched along a peripheral seam 43 along the forefinger sheath 20 and along the back portion so as to enclose the base 38 on all sides except at a mouth 44 of the pocket.

The stiffener element 40 is inserted into the pocket through the mouth 44. This embodiment contemplates a removable stiffener element wherein a player inserts the stiffener element 40 in place. In case this is not desired, the mouth 44 could be closed by the peripheral seam 43 with the stiffener element 40 already in place within the pocket, in which event, the stiffener element would not be removable from the pocket.

A strap 45 having a Velcro (trademark)-type hook fastener 46 thereon is mounted on the glove and is detachably fastened to a corresponding Velcro (trademark)-type loop fastener 48 provided on the outer surface of the back portion 18. The strap 45 not only sizes the glove to fit across the width of the player's hand, but also advantageously overlies the mouth 44 of the illustrated embodiment so as to prevent the stiffener element 40 from falling out of the pocket.

The stiffener element 40 maintains the sheath 20 and the forefinger therein outstretched. The forefinger cannot curl around the club 32, and its tip cannot press against the tip of the thumb due to the presence of the rigid stiffener element. The player's power hand grip, thus weakened and corrected, cannot overpower the swing.

Alternatively, or in combination, the glove can also be provided with another stiffener member 50 associated with the thumb sheath 22 in a manner analogous to that described above for the stiffener element 40. A pocket portion 52 overlies the thumb sheath 22 and is sewn or otherwise attached to the sheath 22 so as to form a pocket in which the stiffener member 50 is received. The stiffener member 50 can be removably or permanently mounted in this pocket. The stiffener member 50 can be mounted in an exterior pocket as shown, or in an interior pocket within the sheath 22. The stiffener member 50 is also made of a rigid, material, preferably a molded synthetic plastic material, and is preferably rounded across its width to conform to the upper surface of the player's thumb.

The stiffener member 50 maintains the sheath 22 and the thumb therein outstretched. The thumb cannot curl around the club 32, and its tip cannot press against the tip of the forefinger.

Figure 6:
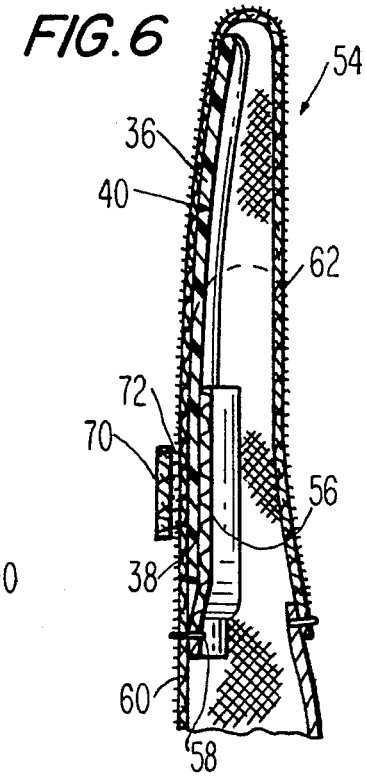
FIG. 6 is a broken-away sectional view taken on line 6—6 of FIG. 5.

Turning now to FIGS. 5 and 6, a second embodiment of a glove 54 is essentially analogous to the first embodiment of the glove 10, but with two differences. The first difference, as previously mentioned, relates to the interior mounting of the stiffener element 40. An interior pocket portion or flap 56 is attached, preferably by being sewn at stitching 58, to a back portion 60 at a distance from a palm portion 62 of the glove. The flap 56 need not have the same peripheral shape or outline as the stiffener element 40 but instead, as shown, can have a different shape. A strap 64 having a Velcro (trademark)-type fastener is detachably mounted over a complementary fastener 66.

The second difference relates to the thumb sheath 68. Rather than using a stiffener member, a connector means or strap 70 is connected to, and extends between, the thumb sheath 68 and the forefinger sheath 72. The sheaths 68, 72 are directly attached to each other in a generally parallel, side-by-side relationship. Since the position of the thumb sheath and, hence, the thumb is fixed relative to the forefinger sheath, the forefinger and the thumb cannot have their tips pressed together.

The strap 70 has a Velcro (trademark)-type hook fastener 72 thereon and fastens directly to the sheath 68 and the back portion 60 of the glove which are both advantageously made of a fibrous loop-type fabric. The strap 70 prevents the thumb sheath 68 from moving relative to the forefinger sheath 72. In the preferred embodiment, rather than using a strap 70, the sheaths 68,72 are stitched or glued directly together. Alternately, the sheaths 68,72 may be formed as a single, common, mitten-like sheath.

Figure 7:
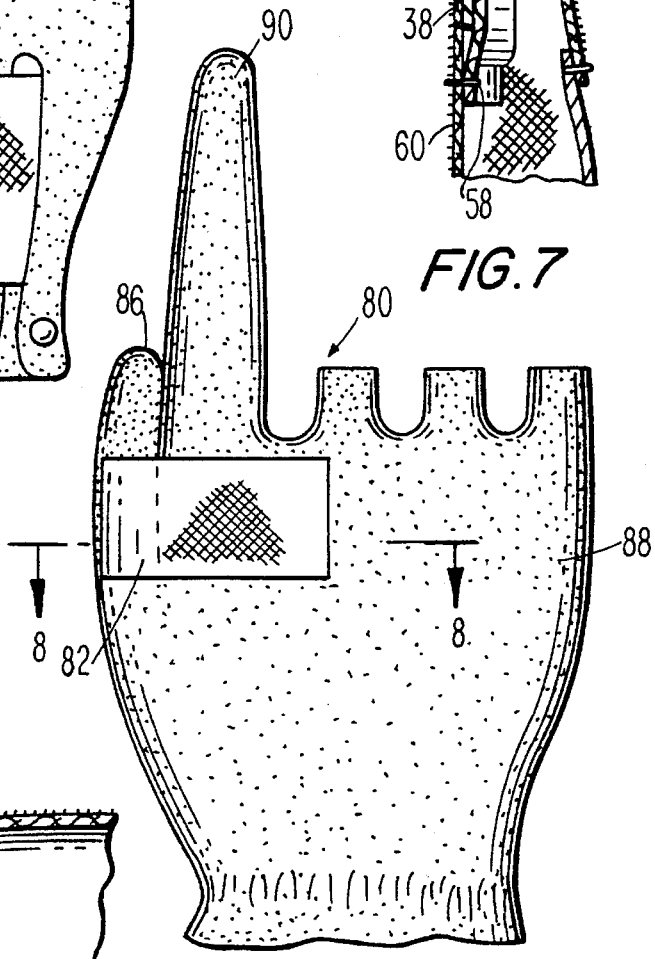
FIG. 7 is a top plan view of still another embodiment of a glove in accordance with this invention.
Figure 8:
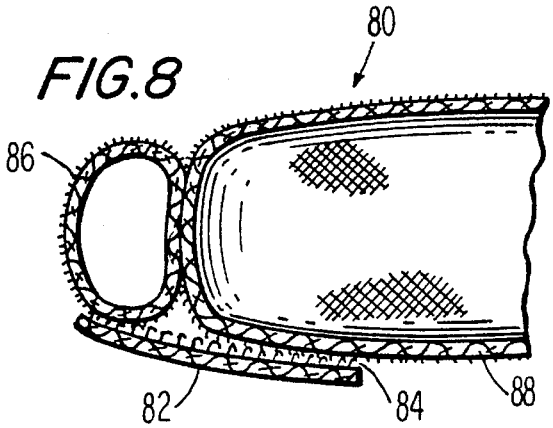
FIG. 8 is a broken-away sectional view taken on line 8—8 of FIG. 7.

In the third embodiment of FIGS. 7 and 8, a glove 80 is shown with only a strap 82 having Velcro (trademark)-type hook fasteners 84 thereon which are attached to a thumb sheath 86 and to a back portion 88 of the glove. The tip of the thumb in the sheath 86 is prevented from bending around the club and from pressing tightly against the tip of a forefinger received in a forefinger sheath 90.

Although this invention has been described and illustrated in connection with a golf club, it is also within the spirit of this invention that the glove could be used with any handled sports implement, such as a bat or racket. Thus, the glove in accordance with this invention has broad application in many activities wherein a sports implement is to be swung at a ball.

It will be understood that each of the elements described above, or two or more together, also may find a useful application in other types of constructions differing from the types described above.

While the invention has been illustrated and described as embodied in a sports glove, it is not intended to be limited to the details shown, since various modifications and structural changes may be made without departing in any way from the spirit of the present invention.

Thus, the invention need not be embodied as a glove, but instead, can be a hand-mounted device that supports the stiffener means in place. In its simplest form, the device may comprise a strap or analogous support operative for supporting the stiffener means.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims.

I claim:

1. A method of resisting overpowering a swing of a handled sports implement by weakening a player's power hand grip on the implement, comprising the steps of:

a) stiffening a forefinger sheath of a power hand cover to maintain the stiffened forefinger sheath outstretched by mounting an elongated, rigid, non-bendable extension along the forefinger sheath;

b) wearing the cover on the player's power hand by inserting a forefinger of the player's power hand into the stiffened forefinger sheath; and c) gripping and swinging the implement while wearing the cover and maintaining the player's power hand forefinger constantly outstretched within the stiffened forefinger sheath.

2. The method according to claim 1; and further comprising the steps of stiffening a thumb sheath of the cover by mounting an elongated, rigid, non-bendable stiffener member along the thumb sheath, inserting the thumb of the player's power hand into the stiffened thumb sheath, and gripping and swinging the implement while the player's thumb is maintained outstretched within the stiffened thumb sheath.

3. The method according to claim 1; and further comprising the step of connecting a thumb sheath of the cover directly to a back portion of the cover in a generally parallel relationship with the forefinger sheath.

4. A device for weakening a player's power hand grip on a handle of a movable sports implement, comprising:

a) a power hand cover including an elongated, outstretched, forefinger sheath for receiving a forefinger of the player's power hand when worn, and a back portion for covering the back of the player's power hand; and b) forefinger stiffener means associated with the forefinger sheath and including a stiffener element having an elongated, rigid, non-bendable, extension extending along the forefinger sheath in a longitudinal direction, for maintaining constantly outstretched the forefinger sheath and the forefinger therein during movement of the implement, and a base integral with the extension, remote from the forefinger sheath, and juxtaposed with the back portion to at least partially overlie the back of the player's power hand.

5. The device according to claim 4, wherein the extension has a curved contour in a transverse direction generally normal to the longitudinal direction.

6. The device according to claim 4, wherein the cover includes a pocket portion juxtaposed with the cover and bounding a compartment for receiving the forefinger stiffener means.

7. The device according to claim 6, wherein the pocket portion is an outer flap secured to an exterior surface of the cover.

8. The device according to claim 6, wherein the pocket portion is an inner flap secured to an interior surface of the cover.

9. The device according to claim 4, wherein the cover includes an elongated, outstretched thumb sheath for receiving a thumb of the player's power hand when worn; and thumb stiffener means associated with the thumb sheath for maintaining outstretched the thumb sheath and the thumb therein.

10. The device according to claim 9, wherein the thumb stiffener means includes an elongated, rigid, non-bendable stiffener member extending along the thumb sheath.

11. A device for weakening a player's power hand grip on a handle of a movable sports implement, comprising:

a) a power hand cover including an elongated, outstretched, forefinger sheath for receiving a forefinger of the player's power hand when worn, and an elongated, outstretched thumb sheath for receiving a thumb of the players' power hand when worn, and a back portion for covering the back of the player's power hand;

b) forefinger stiffener means associated with the forefinger sheath and including a stiffener element having an elongated, rigid, non-bendable, extension extending along the forefinger sheath in a longitudinal direction, for maintaining constantly outstretched the forefinger sheath and the forefinger therein during movement of the implement; and c) connector means for directly attaching the thumb sheath to the back portion in a generally parallel relationship with the forefinger sheath.

12. The device according to claim 11, wherein the connector means includes a strap connected to, and extending between, the thumb sheath and the back portion.

13. The device according to claim 12, wherein the back portion is constituted of a fibrous material, and wherein the strap has hooked extensions for detachable securement to the fibrous material.

* * * * *